US005941921A

United States Patent [19]

Dasys et al.

[11] Patent Number: 5,941,921

[45] Date of Patent: Aug. 24, 1999

[54] SENSOR FEEDBACK CONTROL FOR AUTOMATED BUCKET LOADING

[75] Inventors: Andrew Dasys, Ile Bizard; Louis Geoffroy, Boucherville; André Drouin, Pierrefonds, all of Canada

[73] Assignee: Noranda Inc., Canada

[21] Appl. No.: 08/750,278

[22] PCT Filed: Apr. 19, 1995

[86] PCT No.: PCT/CA95/00213

§ 371 Date: Mar. 19, 1997

§ 102(e) Date: Mar. 19, 1997

[87] PCT Pub. No.: WO95/33896

PCT Pub. Date: Dec. 14, 1995

[30] Foreign Application Priority Data

Jun. 7, 1994 [CA] Canada ..... 2125375

[51] Int. Cl.[6] ..... E02F 3/43

[52] U.S. Cl. ..... 701/50; 414/699

[58] Field of Search ..... 701/50, 300, 2, 701/124; 414/699; 177/141

[56] References Cited

U.S. PATENT DOCUMENTS

| | | | |
|---|---|---|---|
| 3,782,572 | 1/1974 | Gautier | 214/762 |
| 4,230,196 | 10/1980 | Snead | 177/141 |
| 4,288,196 | 9/1981 | Sutton, III | 414/699 |
| 4,641,719 | 2/1987 | Harbour | 177/136 |
| 4,698,570 | 10/1987 | Satoh | 318/568 |
| 4,733,733 | 3/1988 | Bradley et al. | 175/45 |
| 4,838,756 | 6/1989 | Johnson | 414/699 |
| 4,919,222 | 4/1990 | Kyrtsos et al. | 177/139 |
| 4,984,956 | 1/1991 | Ikari | 414/699 |
| 5,065,326 | 11/1991 | Sahm | 364/424.07 |
| 5,116,186 | 5/1992 | Hanamoto | 414/694 |
| 5,250,761 | 10/1993 | Koyanagi | 177/141 |
| 5,308,219 | 5/1994 | Lee | 414/695.5 |
| 5,461,803 | 10/1995 | Rocke | 37/443 |
| 5,528,843 | 6/1996 | Rocke | 37/348 |
| 5,659,470 | 8/1997 | Goska et al. | 364/424.04 |
| 5,682,312 | 10/1997 | Rocke | 364/424.07 |

FOREIGN PATENT DOCUMENTS

| | | |
|---|---|---|
| 0 585 462 | 3/1994 | European Pat. Off. . |
| 59-52308 | 3/1984 | Japan . |
| 2252642 | 8/1992 | United Kingdom . |
| 2279774 | 1/1995 | United Kingdom . |
| 2280047 | 1/1995 | United Kingdom . |
| 9114214 | 9/1991 | WIPO . |

OTHER PUBLICATIONS

"Concept Of An Antonomous System For Piled Ore Shoveling", Shigeru Sarata, Proceedings of the Second International Symposium On Mine Mechanization And Automation, Lulea, Sweden, Jun. 7–10, 1993.

Kumar D. et al., C.I.M. Bulletin, 1993, 86 (974), 39–42.

Wohlford W.P. et al., Proceedings of the 38th Conference on Remote Systems Technology 1990, 2, 228–232.

Mikhirev P.A., Soviet Mining Science, 1986, 22(4), 292–297.

Hemami A. et al., Proceedings of IEEE International Robotics and Automation May 1992, 645–650.

Hemami A. et al., 11th WVU of IEEE International Mining Electrotechnology Conference Jul. 1992, 142–146.

*Primary Examiner*—Michael Zanelli

*Attorney, Agent, or Firm*—Fitzpatrick, Cella, Harper & Scinto

[57] ABSTRACT

Automated bucking loading is achieved through the use of sensor feedback provided by pressure and extension sensors on hydraulic cylinder(s) to control the trajectory of the bucket to be loaded by a computer algorithm. Additional sensors may be used to provide further control of the loading cycle and of the vehicle operation. The structure and steps can be integrated with existing machinery or used on new loaders equipped with suitable control interfaces capable of taking computerized control of the vehicle's actions.

27 Claims, 8 Drawing Sheets

SENSOR FEEDBACK CONTROL FOR AUTOMATED BUCKET LOADING

TECHNICAL FIELD

This invention relates to controlling automated bucket loaders, such as Load-Haul-Dump loaders or LHDs as they are known in the mining industry. More particularly, the invention relates to a tactile control system and method for loaders which have hydraulic actuators for carrying out the loading operation and to loaders comprising such control system.

BACKGROUND OF THE INVENTION

Bucket loaders, such as LHDs, are vehicles having buckets at their front end, which are usually operated by hydraulic actuators or cylinders and which are used to load bulk material, such as rock, into the bucket and transport or haul the same to an unloading area where the material is dumped from the bucket. Normally such loaders are operated by skilled operators who control the many different operations of the working cycle of the vehicle. While sitting in the operator's cabin of the machine the operator can see and "feel" the reaction of the machine when filling the bucket. It is also possible to operate such loaders under computer control from a distance using a remote control device working with radio signals. However, any such operation usually proceeds according to a pre-programmed or predetermined loading cycle and cannot adjust the loader in response to some particular conditions, such as encountering an oversize rock or the like.

Attempts have also been made to tele-operate the loader by installing a TV camera on the vehicle and observing the pile of material to be loaded through such camera while loading the bucket. Such an operation is described by D. Kumar and Nick Vagenas in an article entitled "Performance evaluation of an automatic load-haul dump vehicle" published in the CIM Bulletin, Volume 86, No. 974, pp 39–42, October 1993. This operation cannot be considered as truly automatic since it still requires an operator positioned at a remote location to view the pile of material to be loaded through the TV camera and to operate the loader accordingly. The loader itself does not react automatically to the various loading conditions that may be encountered during such loading operation. In this instance the operator loses all "feeling" of the machine and must rely completely on his sense of vision to interpret the effectiveness of the vehicle's performance. Such vehicles are, therefore, subject to more abuse and usually require more maintenance.

It should be mentioned that when performing the loading cycle there are two objectives to be met: (1) obtaining an efficient loading of the bucket, which should be as full as possible each time the loading takes place, and (2) minimizing the abuse of the vehicle which increases the cost of vehicle maintenance and vehicle down time and thus significantly affects overall productivity.

SUMMARY OF THE INVENTION

An object of the present invention is, therefore, to provide a tactile control system and method for automated bucket loading of a loader, such as LHD, whereby the forces exerted on the bucket during its loading, namely the tactile action-reaction between the bucket and the payload pile, provide immediate feedback control of the loading operation.

Another object of the invention is to provide control of various parameters within the operation of the loader so as to minimize the abuse of the vehicle during the loading cycle.

Other objects and advantages of the invention will become apparent from the following description thereof.

The tactile control system of the present invention is used with loaders, such as LHDs, which have at least one hydraulic cylinder for imparting a tilting trajectory motion to the bucket when loading said bucket with payload, such as a pile of rock, which in mining industry is called "muck".

The basic principle of the system is to use sensor feedback provided by pressure and extension sensors located on the hydraulic cylinder(s) to control the trajectory of the bucket within the muck pile. Additional sensors can then be added to provide further control of the loading cycle and of the vehicle's operation. The vehicle must, of course, be equipped with a control interface providing a mechanism that will allow the computer to take control of the vehicle's actions. The novel system can be easily integrated with existing machinery or incorporated into the manufacture of new loaders.

Thus, the fundamental tactile control system of the present invention provides pressure sensing means for sensing the hydraulic pressure on each side of the piston within the hydraulic cylinder used for imparting the tilting motion to the bucket and extension sensing means for sensing the extension of the shaft of which one end is connected to the piston within the cylinder and the other is acting on the bucket so as to tilt said bucket according to a tilting trajectory of the bucket from the position where the shaft is extended from the cylinder to the one where it is retracted thereinto. A computer is also provided, which is responsive to the output signals of the pressure sensing means and the extension sensing means and which controls valve means that control the pressure on each side of the piston within the hydraulic cylinder and adjust said pressure in response to forces exerted on the bucket during the loading operation, thereby also controlling the extension of the shaft as a function of said forces. The pressure sensing means are pressure sensors which are known in the art, consisting of pressure gauges or pressure transducers mounted so as to essentially continuously (i.e. typically at intervals of about 1/100 of a second) measure the pressure at each side of the piston within the cylinder. The extension of the shaft can be measured either by contact displacement sensors such as a spring loaded wire extensometer or non-contact displacement sensors such as those using a laser beam to show the position or displacement of an object; these are also well known in the art.

The signals from the pressure sensor and displacement sensor are then transmitted to a computer which has an A/D (ANALOG to DIGITAL) converter whereby these signals are converted from analog to digital. Then, the computer has a microprocessor or other signal processing means whereby it computes from said signals, again on an essentially continuous basis, the force exerted on the shaft and consequently on the bucket. The microprocessor operates in conjunction with an algorithm which determines whether the computed force is within predetermined allowable limits. If it is, then the loading operation proceeds as required by applying the pressure on one side of the cylinder to produce retraction of the shaft into the cylinder and the upward tilting of the bucket required for loading of the payload. If, however, the scooping edge of the bucket encounters a large rock or the like that would produce a reactive force greater than that allowed by the algorithm, then the algorithm would act through a controller and suitable control interface to actuate the hydraulic valve that controls the intake of the hydraulic fluid into the hydraulic cylinder so as to increase the hydraulic pressure on the side of the piston which would move the shaft forward, out of the cylinder, and thus tilt the bucket to try and dislodge the rock or other hindrance that produced such excessive force. Thus, the bucket has a tactile feel of the rock pile which continuously and automatically regulates its loading trajectory and allows effective loading while minimizing abuse of the vehicle. In this regard, it will be understood that if no such control were to be provided, then an operator or a camera would be required to see that there is a large rock or similar constraint and make the required adjustments in the loading operation to remove such constraint. According to the present invention the vehicle "feels" such constraint and makes the required adjustment automatically by computer.

The above described fundamental feature is, of course, limited to the actual loading of the bucket of a loader that would be brought to the pile and stationed in front of the pile in a ready-to-load position. In many cases, however, this is not all that is required to achieve a most efficient loading operation. Thus, the loader will also usually have at least one hydraulic lift cylinder or as it is called "boom" for lifting the bucket during or after loading thereof. This lift cylinder also has a piston and a shaft of which one end is connected to the piston within the lift cylinder and the other acts on the bucket so as to lift it off the ground or lower it when required. The statement "acts on the bucket" does not necessarily mean that the other end of the shaft is connected to the bucket; it could act indirectly through a beam, an arm or a frame connected to the bucket, by lifting such beam, etc, or lowering the same and thereby lifting or lowering the bucket. Thus, the present invention further provides pressure sensing means for sensing the hydraulic pressure on each side of the piston within the lift cylinder or boom, and extension sensing means for sensing the extension of the lifting shaft relative to the lift cylinder. The sensors used for this purpose can be identical to or similar to those used for tilting the bucket as described previously.

The computer is also responsive to the output signals from sensors of the boom cylinder, namely to the pressure sensors and the extension sensor, and again it converts these signals from ANALOG to DIGITAL and then uses the information to compute the forces acting on the bucket at any given height of the bucket. The algorithm has force control parameters incorporated thereinto for various heights of the bucket and if they are exceeded when the bucket is raised, the algorithm will activate the controller within the computer and through the control interface will activate hydraulic valve means which will automatically adjust the pressure on the side of the piston that will allow the forces exerted on the bucket to fall back within acceptable limits. It should also be pointed out that the weight of the payload may, when desired, be computed from the output signals of the pressure sensors and extension sensors of the bucket and boom cylinders. This is usually done by the computer at the end of each loading cycle when the payload weight is being determined.

By combining the two controls, namely the control of the bucket cylinder and of the boom as described above, an efficient loading operation is therefore achieved.

In addition, however, to get even more control over the abuse of the vehicle and particularly prevent rapid wear of the tires, the axle of the loader, on which the front wheels are mounted, is provided with load sensing means, such as strain gauges. The computer is again responsive to the signals from such load sensing means and will react when too much load is exerted on the axle by adjusting the various pressures in the appropriate cylinders to reinstate the load on the axle within acceptable limits. This again is automatically controlled by the algorithm which includes the axle load limits within its parameters and transmits the required signals to the controller and the vehicle when required. In fact, the strain gauges located on the vehicle's front axle can be used for a number of functions. The weight applied onto the front wheels allows the algorithm to estimate the amount of material in the bucket, both during the bucket loading operation as well as when the payload is being determined. The strain gauge also allows the algorithm to limit the amount of wheel slippage during the bucket fill operation. This is done by controlling the amount of weight on the front wheels. As the bucket penetrates the muck pile, the wheel acts as a fulcrum for the vehicle, balancing the weight of the vehicle with that of the payload. Thus, modifying the weight in the bucket, modifies the weight applied on the front wheels.

Furthermore, the RPM (revolutions per minute) of the front wheel(s) can be measured by RPM sensing means. RPM sensors are also well known in the art. The signals from the RPM sensor will usually not need to be converted from ANALOG to DIGITAL since they can directly be obtained as digital signals. These will be processed by the computer to maintain the RPM within a predetermined range such as to avoid slippage or spin of the wheels, which is undesirable as it increases the wear and tear of the tires. It would be difficult to determine the wheel RPM directly, however, the driveline RPM can be readily obtained and the wheel RPM calculated therefrom. The algorithm uses the wheel RPM sensor to detect wheel spin. If there is a "significant" amount of wheel spin, the algorithm can modify the weight applied in the bucket to increase traction and thus decrease wheel spin.

Moreover, when loading muck in a mine, the loader or LHD may go up and down the muck pile. It is useful to measure the inclination of the vehicle at any given moment of the operation, for example with an inclinometer. This measurement enters into the overall control of the vehicle. Two inclinometers are usually used for this purpose, which can be located in the computer casing. The inclinometers are positioned to measure the inclination of the machine from the front to the back (pitch) and from side to side (roll). The pitch of the machine modifies the weight component of the bucket and may be used to refine the payload weight measurement. By using the pitch, the computer can also modify its calculations to take into consideration the change in pressure "felt" by the pressure transducers. An abnormal increase in pitch could indicate that the machine's front wheels are climbing the rock pile. An increase in the amount of roll could be an indication that one side of the vehicle's tires are rolling on a rock, again causing wear and tear. Proper adjustments are then automatically made by the computer.

Further to the above measurements and parameters, and particularly when considering the abuse of the vehicle, certain additional vehicle operational parameters may also be taken into account.

Thus, sensing means may be provided for the RPM of the loader's engine and the computer being responsive to output signals of the engine RPM sensor to maintain said RPM within a predetermined range thereby limiting abuse on transmission, axle and drive train of the loader.

This type of loader also usually comprises a hydraulic steering cylinder to perform the steering of the vehicle. This steering cylinder may be provided with extension sensing means to sense its extension and the computer being responsive to output signals from such extension sensor to maintain the loader substantially straight during the loading operation. It is obvious that when the loader is in a turning mode or is not straight, it cannot exert as much pushing force during loading of the bucket as it would when it is straight and this particular parameter enables to insure that loading takes place only when the vehicle is positioned essentially in a straight line.

Also, the vehicle position with reference to the muck pile is an important parameter which enables the vehicle to "know" where it is during the loading operation. This position may be determined and controlled by providing a position sensing system with reference to a predetermined target and the computer being responsive to the output signals form said position sensing system to control the position of the loader with reference to the target and thus to the muck pile, during the loading operation. A laser positioning system mounted on the loader and projecting a laser beam onto a predetermined target behind the loader, for example made of three reflective strips, is particularly suitable for this purpose. Such laser positioning systems are already known in the art and can be used to calculate not only the distance of the vehicle, but also the orientation thereof as well as the position of the vehicle relative to the walls, the angles of the vehicle and its speed.

Finally, the temperature of the hydraulic fluid within the system is another important parameter. If the temperature is too low, the machine's operations are slower and therefore not at an optimum level. On the other hand, if the temperature is too high, there is danger that the system will overheat and the machine may need to be stopped to cool down the hydraulic fluid. Thus, the computer may also be made responsive to the signals from the temperature sensor, such as a thermocouple, to operate the vehicle within predetermined temperature limits.

A number of further sensors may also be added to the invention to monitor critical vehicle parameters. These parameters could include engine oil temperature, oil pressure and brake fluid levels. These sensor values would then be compared to acceptable ranges within the algorithm and automatic adjustments or stoppage of the vehicle would be made if they are exceeded. Such vehicle monitoring systems are already generally known in the art.

Obviously, to convert the various signals from analog to digital form, which can then be used for various calculations and control of the vehicle, the computer comprises and A/D converter and once the signals are so converted, a microprocessor is used to perform the required computations and to use an appropriate algorithm and a controller for controlling the various operations as a function of such computations and algorithm. The controller normally operates through a remote control interface.

The method for a tactile control of an automated bucket loading operation according to the present invention comprises: sensing the parameters mentioned above, essentially on a continuous basis; converting the output signals from the various sensors into digital signals when such signals are initially analog; processing the digital signals using an algorithm that will maintain the various parameters within predetermined limits; and, on the basis of said algorithm, automatically controlling the various parameters through a suitable controller, such as a hybrid controller.

Thus the system and the method of the present invention can be specifically designed to fulfill the loading operation in a most efficient manner from the standpoints of filling the bucket and reducing as much as possible the abuse of the vehicle. The system uses sensor feedback and a vehicle model, incorporated in a suitable controller, e.g. a hybrid controller, to control the trajectory of the bucket and the operation of the vehicle when loading from a pile of rocks or the like. Feedback is provided by various sensors located within the vehicle, such as the pressure and extension sensors located on the boom and bucket cylinders and does not rely on a model of the muck pile, nor is there an optimum bucket trajectory determined prior to the mucking operation.

The operation according to the invention requires little user intervention. When operating the system, the user is required to position the vehicle in front of the muck pile, to "launch" the mucking or loading program and then merely to supervise as the mucking proceeds and intervene only if required. The mucking function (filling the bucket) is performed by the computer which is usually mounted on the vehicle. Intervention between the vehicle and the operator is done via a radio remote control, which is known in the art. When testing the invention, Nautilus remote control was used, but the invention is by no means limited thereto and any other remote control would provide or could be made to provide the required functionality. The system has some limited adaptability ("learning") in so far as it is capable of modifying its behavior during the mucking or loading operation to increase the effectiveness of bucket loading. In other words, the program uses the feedback from prior mucking cycles to increase the effectiveness of future cycles within the same loading operation. As mentioned above, the invention relies on a number of vehicle mounted sensors and an on-board computer to perform the mucking or loading function. Although in the most basic system the number of sensors may be limited to pressure transducers mounted on both sides of the bucket cylinder and an extension sensor of the bucket cylinder, in most situations the system will include measurement of other parameters as well, such as extension of the boom and steering cylinders, pressure transducers on both sides of the boom, strain cells welded on the front axle of the vehicle, inclinometer and RPM meters as well as a thermocouple to measure the temperature of the hydraulic fluid. All sensors are wired to the computer which is enclosed in a waterproof box when operating in a mine or other "wet" environments. Associated with the computer are a number of off-the-shelf cards that are used for data acquisition, data storage and communication. An amplification/filter card is also included. Also an off-the-shelf A/D converter is associated with the computer to convert the analog signals from the sensors into digital signals that are then processed by the computer. The computer can operate with any suitable operating system.

The control of the computer is done by means of a mucking algorithm. This algorithm uses sensor feedback to provide information to a controller, e.g. a hybrid controller, that then modulates the extension of the bucket and, when necessary, boom cylinders, as well as various other parameters of the vehicle's sub-systems to fill the vehicle's bucket while minimizing abuse of the vehicle.

The "feel" of the muck or rock pile is used to determine the mucking or loading cycle which would proceed as follows:

Place the vehicle in front of the muck pile;

Advance "touch" the muck pile with the bucket;

Tilt or oscillate bucket while advancing;

Weigh bucket after it is loaded; and

Terminate and return control to operator.

Because the system is not based on a model of the muck pile, but instead uses the "feel" of the muck pile, it can be readily adapted to different mucking or loading conditions found in the mines and elsewhere. However, this invention does not include any components capable of vehicle trajectory planning, path following or obstacle detection, but it could be incorporated into an "automation framework" using such various other components. It can also be used by itself as a human supervised, automatic mucking or loading device.

A loader, such as an LHD, having a tactile control system described herein is obviously included within the scope of the present invention.

BRIEF DESCRIPTION OF THE DRAWINGS

The invention will now be described with reference to the appended drawings, in which.

DETAILED DESCRIPTION OF THE INVENTION

Figure 1:
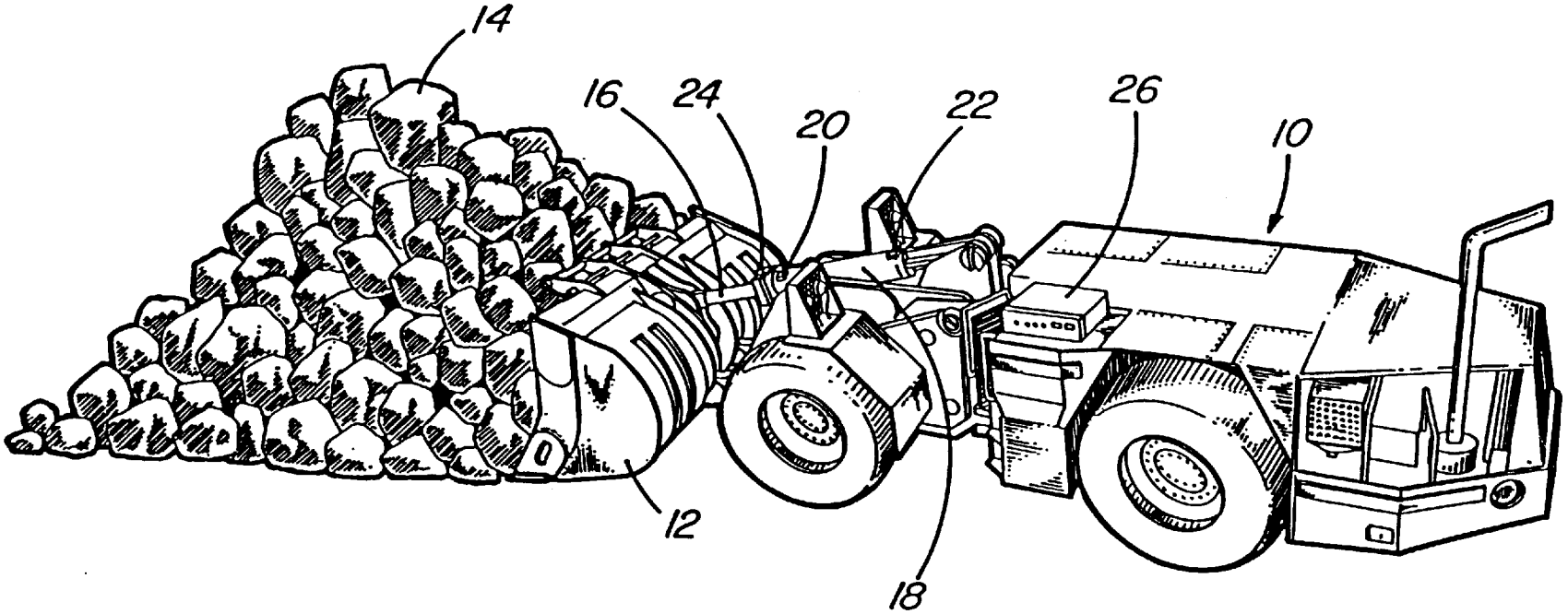
FIG. 1 illustrates a loader positioned in front of a rock pile in a "ready to start loading" position.

Referring to FIG. 1, it shows a loader 10 with its bucket 12 positioned against a rock pile 14 in a ready-to-load position. The bucket 12 is open towards the pile 14 and shaft 16 of hydraulic cylinder 18, which pivots the bucket 12 upwards while loading the same, is in an extended condition.

Pressure sensors 20 and 22 are provided at each end of the hydraulic cylinder 18 to measure pressures $P_1$ and $P_2$ on each side of the piston within the cylinder. Also an extensometer 24 is provided to measure extension $E_1$ of the shaft 16 out of the cylinder. The output signals of $P_1$, $P_2$ and $E_1$ are communicated to a computer 26 which processes these signals according to an algorithm provided therein so as to maintain a suitable force on bucket 12 as it is rolled back and filled with rock. The computer 26 has a controller which controls the hydraulic valve that supplies hydraulic fluid into both ends of the cylinder 18 and if too much force is exerted on the bucket by the rock pile, the command for hydraulic fluid intake will be reversed and the fluid will be injected into the opposite side of the piston within cylinder 18 so as to reverse the action of shaft 16 until the force drops to a predetermined level. Then, the oil intake will be reversed again and the tilting action of the bucket will be resumed until the bucket 12 is filled and is in the rolled back position shown in FIG. 2.

Figure 2:
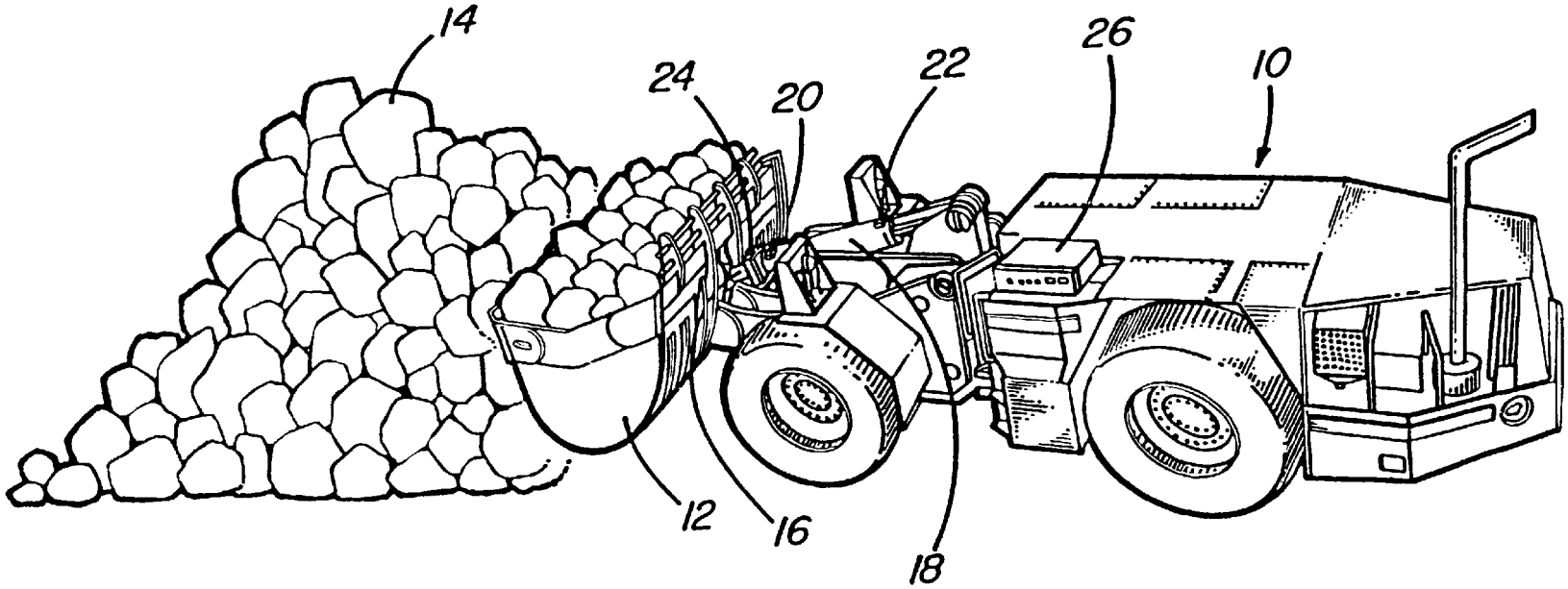
FIG. 2 illustrates the same loader in which the bucket has been loaded with rock.

As shown in FIG. 2, in this position, bucket 12 is filled with rock and shaft 16 is in essentially retracted condition. The loader is ready to back up and go to the area where the muck will be dumped and, thereafter, return to the muck pile 14 for another loading operation. The movement of the bucket 12 from its position shown in FIG. 1 to its position shown in FIG. 2 constitutes its loading trajectory.

Figure 3:
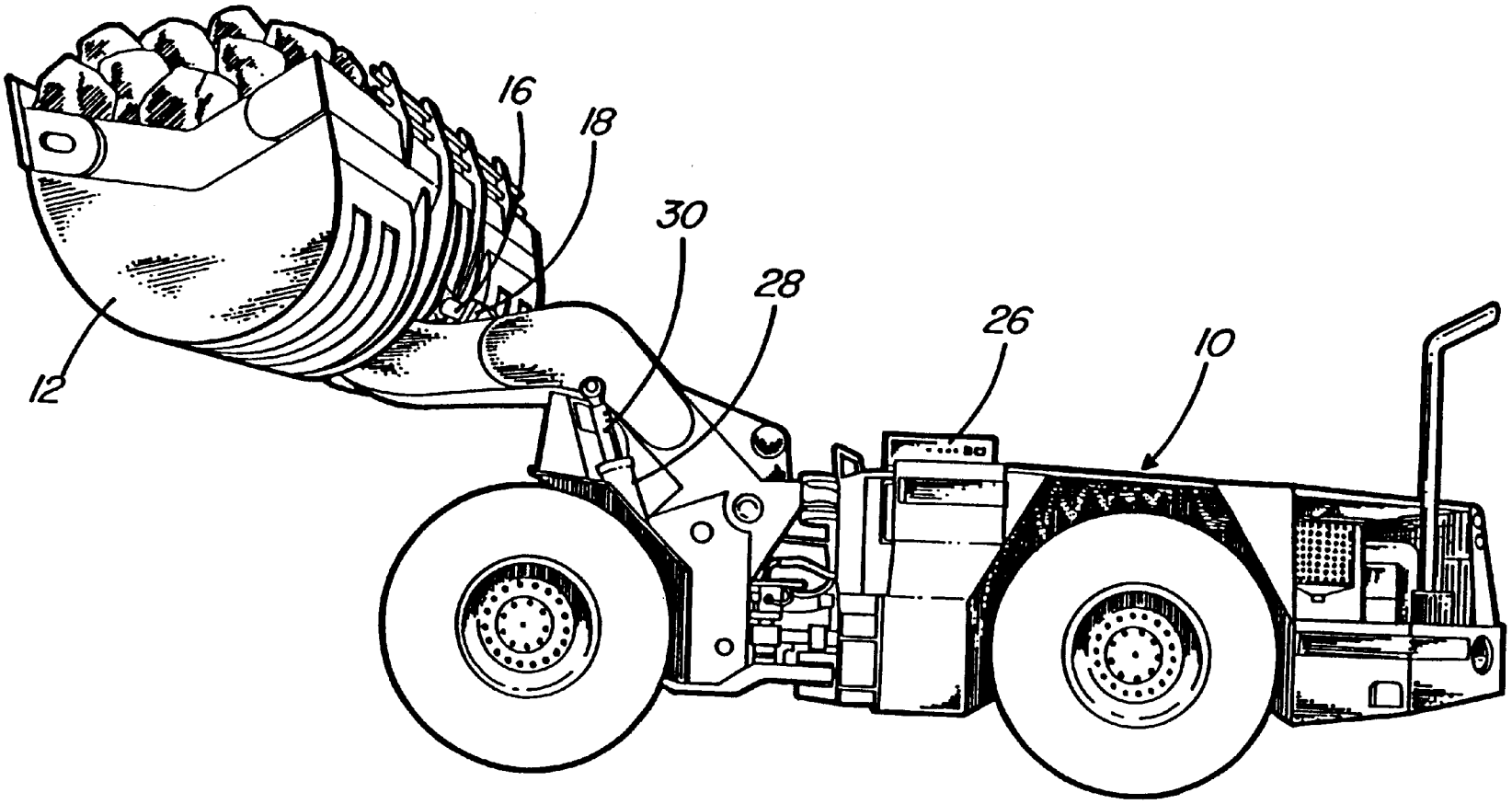
FIG. 3 is a side view of a loader in which the bucket has been raised using the lift cylinder or "boom"

The loader 10 shown in FIG. 3 has its bucket 12 in a position raised from the ground. This is achieved by means of a lift cylinder or boom 28 and shaft 30 extending therefrom. By measuring the extension $E_2$ of the shaft 30 and hydraulic pressures $P_3$ and $P_4$ on each side of the piston in the cylinder 28, the forces acting on bucket 12 at any given height of the bucket can be computed by computer 26 and taken into account in controlling the loading operation. Thus, not only the trajectory of the bucket from the position shown in FIG. 1 to the position shown in FIG. 2 would be controlled according to this embodiment, but also the height of the bucket above the floor level.

Figure 4:
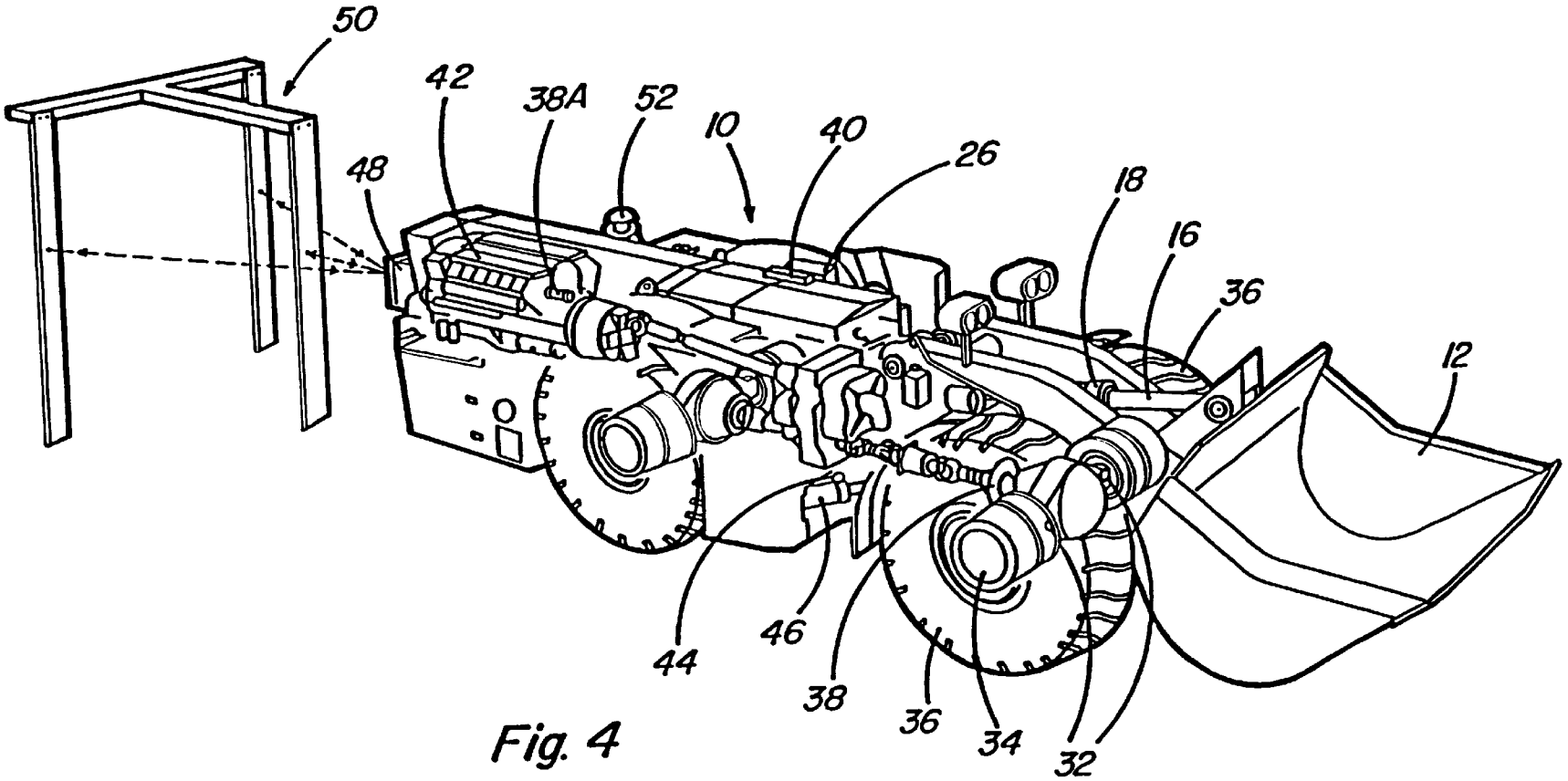
FIG. 4 illustrates a loader in greater detail showing various parts and sub-systems where sensors are located pursuant to the present invention.

FIG. 4 illustrates loader 10 in greater detail showing the various sensors that may be used therein in accordance with the present invention. The pressure and extension sensors used with reference to hydraulic cylinder 18 and shaft 16 have already been discussed in conjunction with FIGS. 1 and 2 and with reference to the boom cylinder 28 and shaft 30 in conjunction with FIG. 3. They will, therefore, not be repeated with reference to FIG. 4. In addition, however, load cells 32 may be positioned on the front axle 34 to measure the load exerted on the front axle during the loading operation. The signals from these load cells go to the computer 26 where they are processed with the other signals within the overall algorithm, to keep the load on the axle within predetermined limits. This enables to minimize the wear and tear on tires 36 of the vehicle.

An RPM sensor 38 can also be provided to monitor axle RPM. The signals from this sensor are also controlled by the computer 26 to maintain RPM within a predetermined range and thereby avoid slippage of the front wheels or wheel spin.

Moreover, one or two inclinometers 40 may be provided on the loader to measure the incline of the vehicle as loading proceeds, and this is normally used by the computer to enhance the calculation of the payload weight in the bucket 12.

Then the system may comprise engine RPM sensor 38A which monitors the RPM of the engine 42 used to power the vehicle. The engine RPM signals are used by the computer to limit the abuse on transmission, axle and drive train of the loader.

Furthermore, the system may comprise an extensometer 44 for the steering cylinder 46 and the computer 26 is responsive to the output signals from it to maintain the vehicle straight during the loading operation.

Also, a loader position sensing system comprising a laser beam emitter 48 and a target 50 made of three reflective strips which allows to monitor the distance from the back of the loader 10 to the target 50 and, therefore, the position and orientation of the loader with reference to the target. The signals are again used by the computer to control the position of the loader and its orientation with reference to the rock pile at the front of the loader.

Finally, a thermocouple 52 is provided to monitor the temperature of the hydraulic fluid used within the system and the computer 26 again uses this information to operate the vehicle within predetermined limits.

Figure 5:
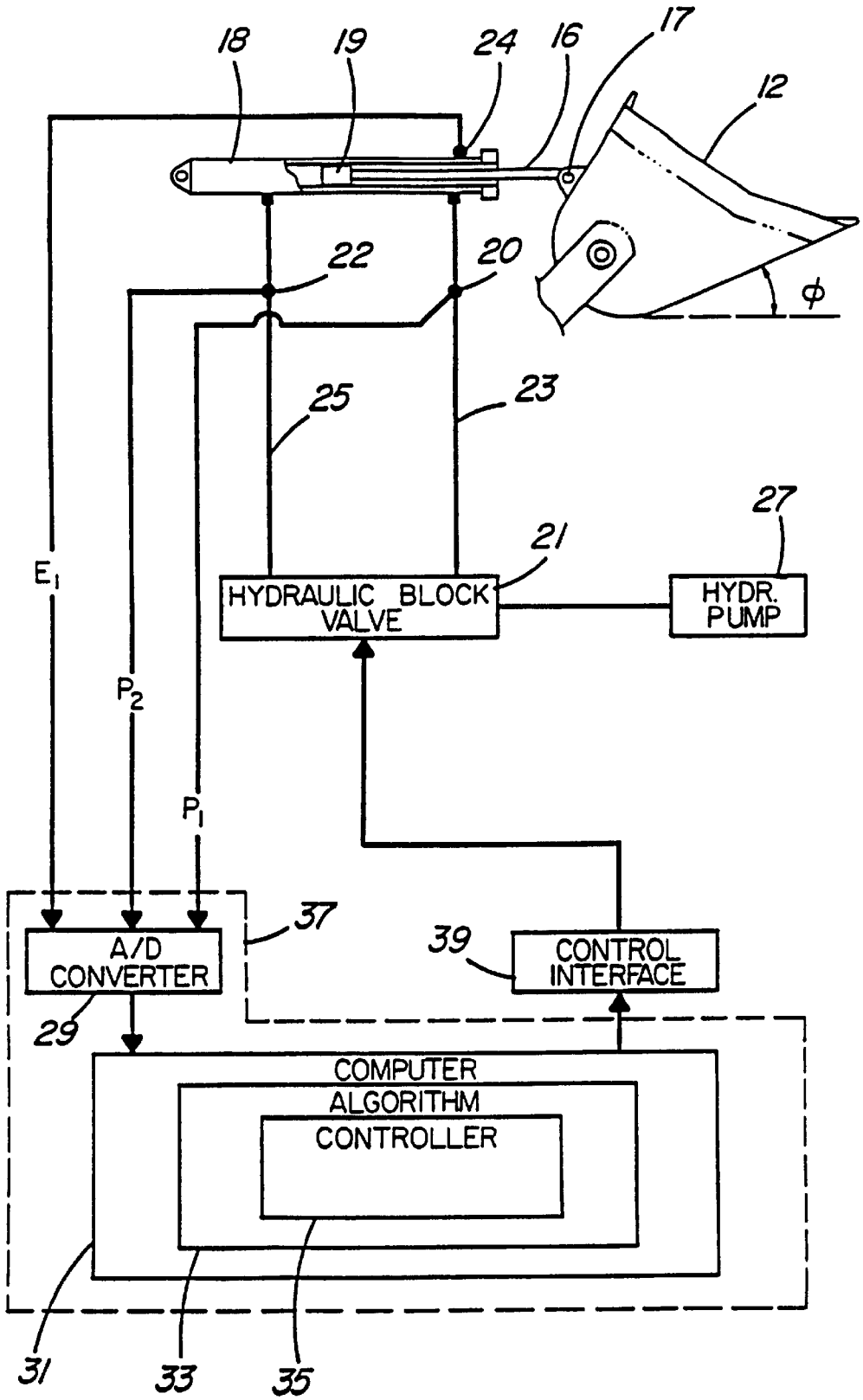
FIG. 5 is a diagrammatic illustration of an embodiment of the tactile control system according to this invention.

FIG. 5 illustrates the basic operational diagram in accordance with the present invention. The bucket 12 is tilted by shaft 16 of hydraulic cylinder 18. One end 17 of shaft 16 is connected to the bucket whereas the other end of shaft 16 is connected to piston 19 within the cylinder 18. A hydraulic block valve 21 is connected via two conduits 23 and 25 to the opposite ends of the hydraulic cylinder 18 and controls the amount of hydraulic fluid flowing on each side of the piston 19 and thereby the movement of said piston one way or the other and accordingly the extension of shaft 16 out of cylinder 18. Hydraulic pump 27 is used to pump the hydraulic fluid from a reservoir (not shown) and through the valve 21, into cylinder 18 at either side of piston 19.

Pressure sensors 20 and 22 are used to essentially continuously measure the hydraulic fluid pressures at each side of piston 19, giving signals $P_1$ and $P_2$ representing said pressures.

Extensometer or extension measuring sensor 24 is provided on the cylinder 18 to measure the extension of shaft 16 out of the cylinder 18. The signal from this sensor is identified as $E_1$. These signals $E_1$ along with $P_1$ and $P_2$ proceed to an A/D converter 29 where they are converted from analog to digital signals which then proceed to computer 31, both installed within computer casing 37. Computer 31 executes an algorithm 33, including hybrid controller 35, used to maintain pressures $P_1$ and $P_2$ within predetermined values. Thus, if the bucket 12 encounters too much force which exceeds the limits assigned to it by the algorithm, the controller 35 will provide a command through a control interface 39 to valve 21 which will shut off the normal flow of hydraulic fluid through conduit 23 and initiate flow through conduit 25 in order to relieve the pressure on the bucket. Then once the pressure is relieved to a level within acceptable limits, the controller 35 will again give the command to reverse the flow of hydraulic fluid, thereby allowing to proceed with the loading operation.

Figure 6:
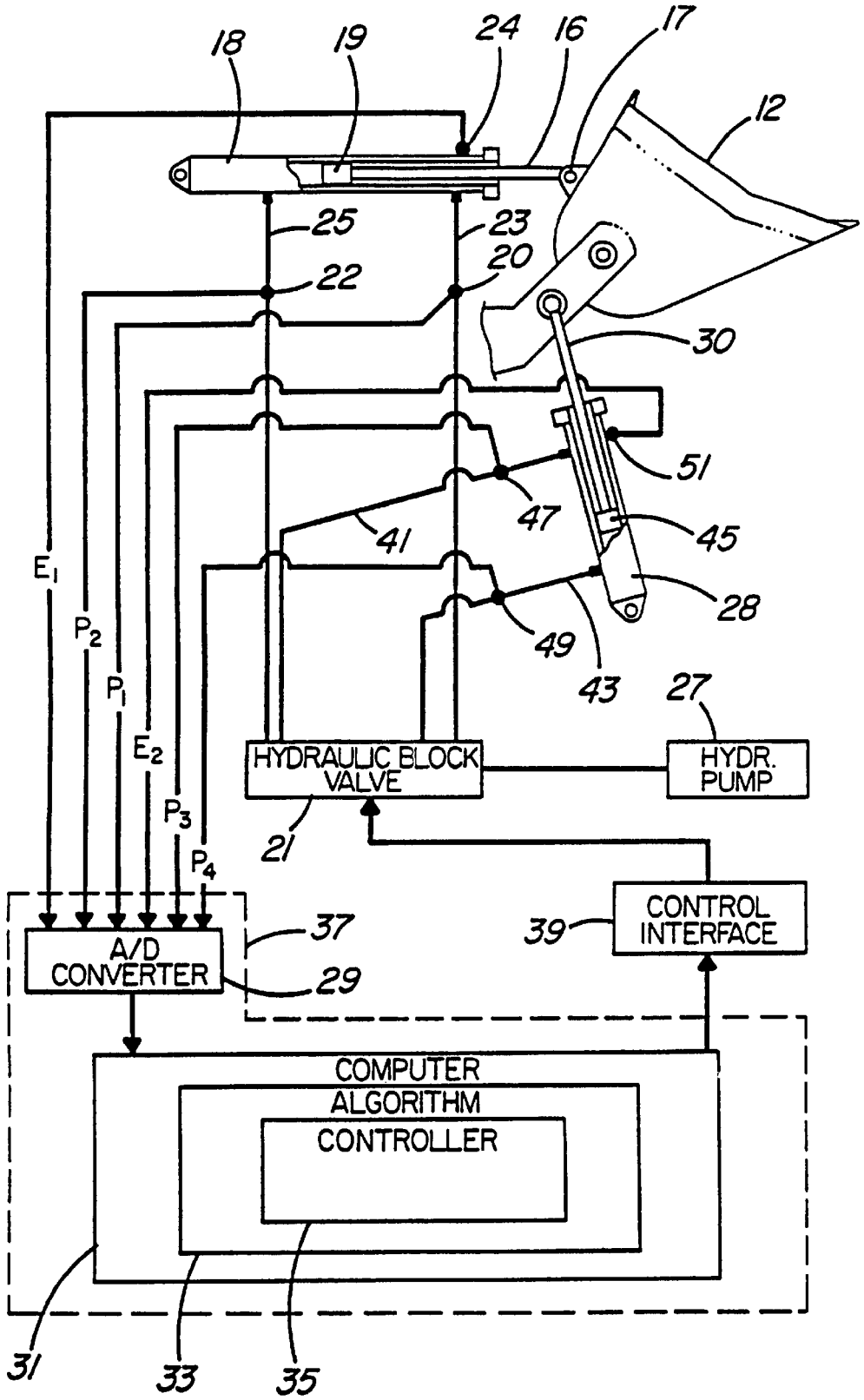
FIG. 6 is a diagrammatic illustration of another embodiment of the tactile control system according to this invention.

FIG. 6 illustrates a diagram similar to FIG. 5, however, it further includes a boom or lift cylinder 28 with shaft 30 extending out of said cylinder to-lift bucket 12 when required. Conduits 41 and 43 are used in conjunction with block valve 21 to control the inflow of hydraulic fluid on each side of piston 45 within cylinder 28. Pressure sensors 47 and 49 produce signals $P_3$ and $P_4$ indicating the pressure on each side of the piston 45 and extensometer 51 produces signals $E_2$ to indicate the extension of shaft 30 out of cylinder 28. These signals are then processed by computer 31 to determine the forces on bucket 12 and again the pressures $P_3$ and $P_4$ are controlled by controller 35 through the control interface 39 to maintain these forces within predetermined limits defined by algorithm 33. Simultaneously, signals $P_1$ and $P_2$ as well as extension $E_1$ are monitored as described with reference to FIG. 5 and controlled to remain within predetermined values. Hydraulic valve 21 and pump 27 can be used for both cylinders 18 and 28.

Figure 7:
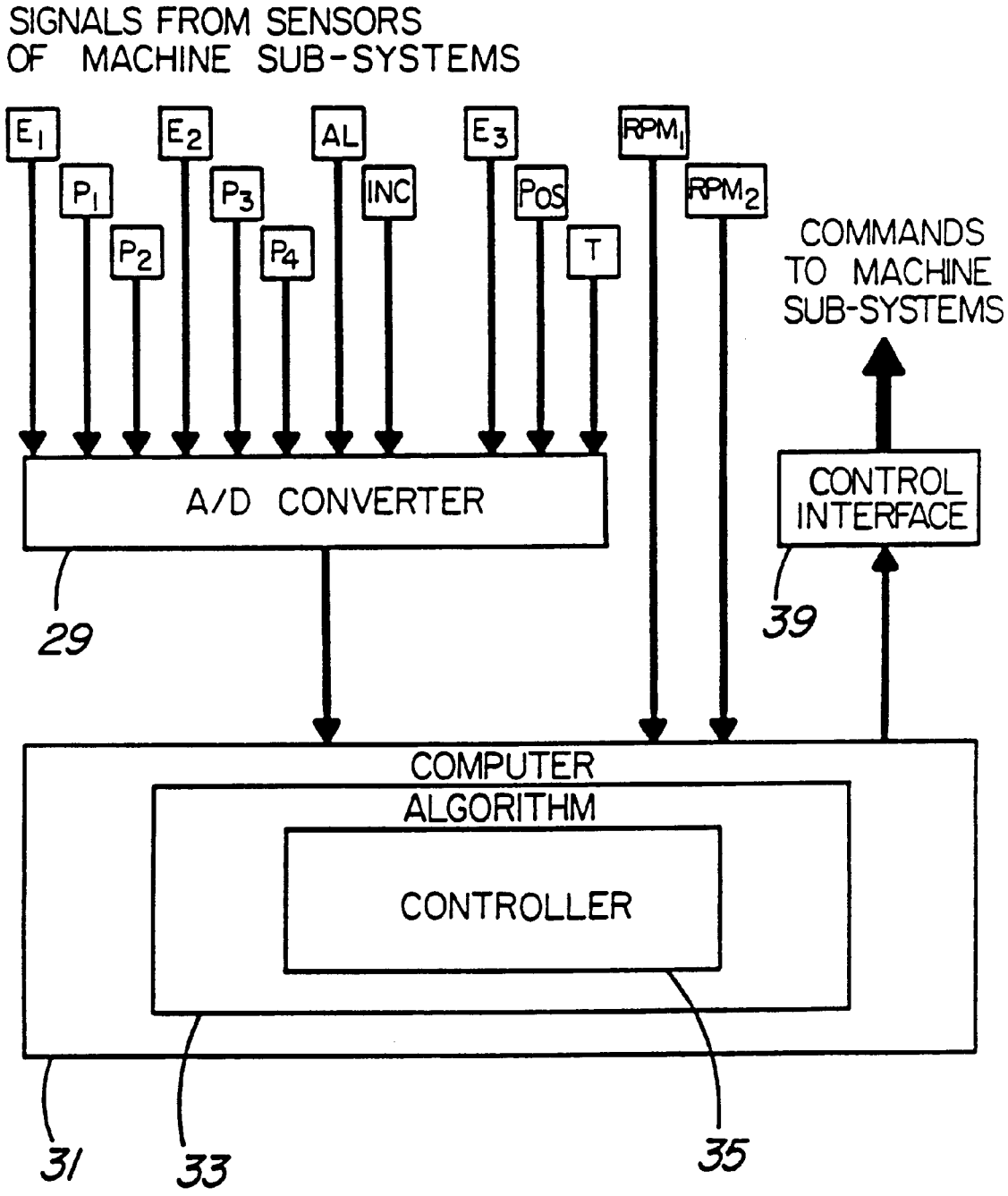
FIG. 7 is a diagrammatic illustration of a further embodiment of the tactile control system according this invention.

FIG. 7 illustrates the processing of the signals from sensors of machine sub-systems in accordance with the present invention. These various signals are as follows:

$E_1$=elongation of the bucket cylinder $P_1$=pressure on one side of the piston in the bucket cylinder $P_2$=pressure on the other side of the piston in the bucket cylinder $E_2$=elongation of the boom cylinder $P_3$=pressure on one side of the piston in the boom cylinder $P_4$=pressure on the other side of the piston in the boom cylinder AL=axle load strain gauge signals INC=inclinometer signals $E_3$=elongation of the steering cylinder POS=vehicle position signals T=temperature of hydraulic fluid $RPM_1$=RPM of the front wheels $RPM_2$=RPM of the engine.

Most signals are in analog form and are processed through an A/D converter 29 to convert them into digital form suitable for processing by computer 31. The RPM signals can, however, be obtained directly in digital form and thus may not require A/D conversion. The computer 31 executing algorithm 33, including hybrid controller 35 to process the signals, establish if they are within the required parameters and, if not, issue the required commands to the machine sub-systems through the control interface 39 in order to bring these signals back to the required level. Although in FIG. 7 a number of signals have been identified, it should be pointed out that the basic essential signals are only $E_1$, $P_1$ and $P_2$ and these can be combined with one or more other signals to produce the most efficient loading operation in any given circumstance. If the machine has other sub-systems that may affect or be affected by the loading operation, signals from such sub-systems may also be included in the overall equation when appropriate. In other words, this invention cannot be circumvented by merely measuring and controlling some additional parameter of the machine's operation over and above those discussed above with reference to FIG. 7.

Figure 8:
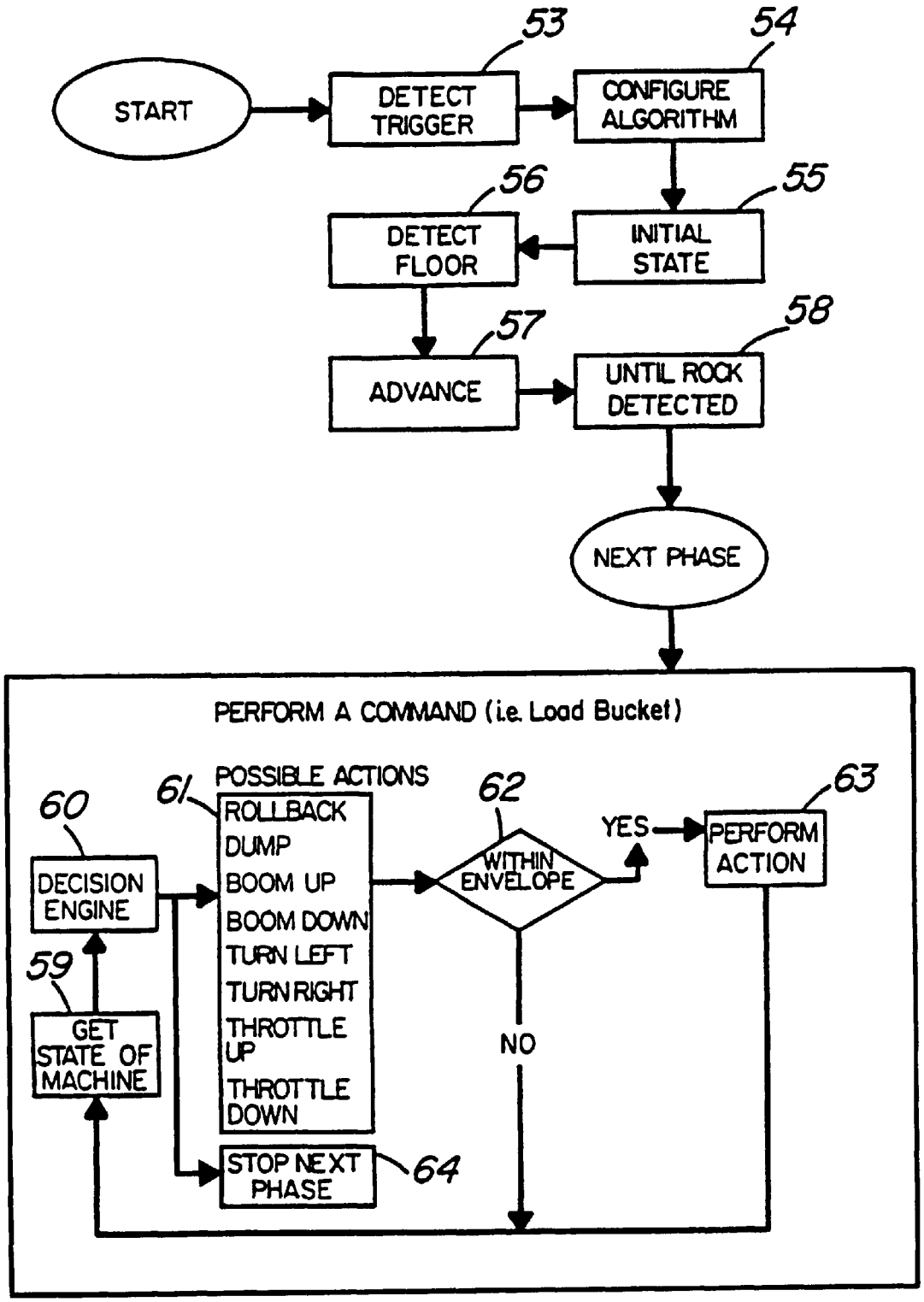
FIG. 8 is a flow chart illustrating the operational steps of the algorithm to perform the automatic loading pursuant to this invention.

Finally, the method of operation of the system in accordance with the present invention is illustrated by the simplified flowchart shown in FIG. 8. The program is ready to start, to take control of the vehicle, once the operator has placed the vehicle in front and in close proximity of the muck pile. At this point the program has already been configured and has a parametric model of the vehicle in memory. However, the mucking cycle must still be selected from those held in memory. This is done by the operator at 53 simultaneously as he triggers the algorithm. The computer then uses the operator selected configuration 54 for the mucking sequence. The configuration determines the values and limits of initial parameters of the full mucking cycle, thus determining the operating envelope 62. It is this envelope that changes once the vehicle begins loading the bucket. Different envelopes can be maintained in the computer's memory for a variety of materials to be loaded.

Once triggered, the algorithm determines the initial state that will indicate that it should begin the bucket load operation. This trigger is provided by the operator on a remote control. Once triggered, the algorithm determines the initial state that the vehicle is in at step 55. This includes determining its position and the initial position of its members (members refer to any moving part of the machine, such as bucket cylinder, boom, etc). During this step the algorithm initial readings are taken by the sensors while the vehicle is at rest. The next action of the approach phase is to detect the location of the ground at step 56; the bucket is lowered until it touches the floor. Then step 57 provides for the advance of the vehicle until rock is detected at 58.

The next phase, relating to the loading of the bucket, will complete the mucking cycle without the need of operator intervention, except perhaps in emergency situations. Depending on the state of the machine 59, control parameters 61 will be modified by decision engine 60. The modification of these parameters automatically changes the operating envelope 62 of the machine. If the parameters fall within this envelope 62, the required action 63 selected at 61 will be performed, otherwise the state of the machine 59 will be modified to place the parameter within the envelope 62.

An example of the operating envelope can be described for the simplest case of the mucking algorithm. This case includes only the use of the bucket cylinder to control mucking. In this case the parameters used to define the operating envelope include: cylinder extension (minimum and maximum), cylinder pressure (minimum and maximum) and time. The algorithm will control the vehicle as long as each parameter is maintained within its appropriate limits (i.e. within the operating envelope).

The relative position of each measured parameter within the operating envelope also defines what action the algorithm can take. This can be best expressed as a number of rules codified within the algorithm. In the above example, if the algorithm "feels" that it cannot move the bucket and it is at the minimum cylinder extension (the bucket is completely rolled back) then it "knows" that in order to complete the load of the bucket it may perform all actions other than rolling back the bucket. In this case the lower limit on the dump cylinder extension eliminates a behavior that the vehicle can use to fill its bucket. Rolling back the bucket would go beyond the minimum allowed extension (i.e. outside the operating envelope) and thus stress the system without increasing the efficiency of the bucket filling.

As mentioned above, the first step in the algorithm is to use the on-board sensors to determine the current state of the machine at 59. This state will determine the priority of each of the possible commands. Having selected a possible command by decision engine at 60, the system then verifies that the commands will maintain the vehicle within its operating envelope 62. If the second command would place the vehicle outside of its operating envelope, then the algorithm must choose another possible action. If all of the commands would cause the system to move outside of the envelope, then the vehicle would have to use its last possible option, namely "stop" at 64. Although the explanation above has been simplified, this is the type of decision that the algorithm will make on a continuous basis to perform the bucket loading operation.

To verify if a command would place the vehicle in a state outside its operating envelope the algorithm must be aware of the physical components making up the vehicle (i.e. length of cylinders, total extensions . . . ). This is done with an internal software model of the vehicle stored in computer memory. The model of the vehicle not only covers the static configuration of the vehicle (member lengths and connections) but also the dynamics of the system (time to turn, rotation limits . . . ). This allows the algorithm to implement prediction in its calculations.

Prediction is used to determine what state the machine will be in at the end of a command. This allows the algorithm to determine whether implementing a command will cause the system to go outside its operating envelope. In such a case the algorithm would have to either modify the command or select a new command to continue with the bucket fill operation.

As the bucket is moving within the muck pile the sensors located on the vehicle can determine whether the bucket loading operation is progressing properly or whether the vehicle is encountering difficulties. As mentioned earlier, in a case of difficulty the vehicle attempts to use a number of different actions to perform the bucket loading. The relative ease of bucket filling or "rock viscosity" is quantified using the following equation:

$$\text{Rock Viscosity} = \frac{\text{Rollback Pressure}}{\text{Rollback Rate}}$$

This equation is purely empirical. The equation allows the computer to estimate the "fluidity" or "viscosity" index for the rock pile. This value is calculated for each bucket oscillation in the rock pile. In the above equation, the Rollback Pressure is the average pressure exerted during the rollback cycle of the bucket, and the Rollback Rate is the distance divided by the time the cylinder has taken to travel said distance during the rollback cycle.

The summation of the rock viscosity index is used to estimate how well the overall bucket loading operation was. This is represented empirically by the following equation:

$$\text{Looseness Index} = \frac{\sum[\text{Rock Viscosity}\cdot\text{Distance Travelled}\cdot\cos(\text{Bucket Angle})]}{\text{Bucket Payload}}$$

In the above equation, the Distance Travelled refers to the distance travelled by the vehicle during the loading operation and the Bucket AngIe is angle $\phi$ between the bucket and the floor as shown in FIG. 5 and, finally, the Bucket Payload is the weight of the contents of the bucket at the end of the loading operation.

The looseness index represents the amount of work that is performed by the vehicle during a complete bucket filling operation and uses the summation of the rock viscosity values for each bucket oscillation. This value can be utilized to determine which type of configuration should be employed to load a given type of rock, from one bucket load to the next.

As described earlier, the bucket loading phase of the algorithm uses a decision tree or engine 60 to select a command at 61. The acceptance criteria is based on maintaining the vehicle within the operating envelope 62. The decision tree is also guided by a number of rules (such as if the last action was dump, then there is a high probability that the next command should be rollback). The decision tree is coded within the control algorithm, and is configured at the beginning of the mucking cycle 53.

The final phase 64 of the bucket load algorithm is termination. This phase will be triggered by the machine either once the bucket is full or when it reaches a state where it can no longer continue loading the bucket. Once triggered, the machine will stop and the operator would regain control of the vehicle. The operator has then the option of either performing an additional command (e.g. checking bucket weight) or direct the vehicle to the place for dumping the payload.

The above computerized system has been extensively tested in the field. Over one hundred tests have been performed and compared to similar "human" operations. On the average the weight results of human and computer mucking were as follows:

Human: 13962 lbs/bucket fill

Computer: 15251 lbs/bucket fill.

Consequently, on the average, there has been over 9% improvement in loading capacity using the computerized tactile system of the present invention.

We claim:

1. A tactile control system for automated bucket loading of a front shovel loader having at least one hydraulic cylinder for use in imparting a tilting motion to the bucket when loading said bucket with payload, said cylinder having a piston and a shaft of which one end is connected to the piston within the cylinder and the other is acting on the bucket so as to tilt said bucket according to a tilting trajectory when the shaft extends from the cylinder or retracts thereinto, said system comprising:

pressure sensing means for sensing hydraulic pressure on each side of the piston within the hydraulic cylinder;

extension sensing means for sensing the extension of the shaft; and a computer responsive to output signals of said pressure sensing means and said extension sensing means, said computer controlling valve means which control the pressure on each side of the piston within said hydraulic cylinder and adjust said pressure in response to forces exerted on the bucket during the loading operation, thereby also controlling the extension of the shaft as a function of said forces.

2. A system according to claim 1, wherein the loader also has at least one hydraulic lift cylinder for lifting the bucket during or after loading thereof, said lift cylinder having a piston and a shaft of which one end is connected to the piston within the lift cylinder and the other acting on the bucket so as to lift it off the ground or lower it when required, said system further comprising:

pressure sensing means for sensing the hydraulic pressure on each side of the piston within said lift cylinder;

extension sensing means for sensing the extension of the shaft relative to the lift cylinder; and the computer also being responsive to output signals of said lift cylinder pressure sensing means and extension sensing means, said computer also controlling valve means which control the pressure on each side of the piston within said lift cylinder and adjust said pressure in response to the forces exerted on the bucket.

3. A system according to claim 2, wherein the computer is responsive to the signals from at least one of the hydraulic cylinder for imparting the tilting motion, the hydraulic lift cylinder and the output signals from the axle load sensing means, to compute the payload weight.

4. A system according to claim 3, further comprising an inclinometer on the loader for sensing the inclination thereof, and the computer being responsive to output signals of the inclinometer to enhance computation of the payload weight.

5. A system according to claim 1, wherein the computer comprises an A/D converter to convert the output signals from analog to digital, an algorithm suitable to perform predetermined computations and a controller for controlling the various operations as a function of said algorithm.

6. A system according to claim 5, wherein the controller operates through a control interface.

7. A system according to claim 6, wherein the control interface is a remote control interface.

8. A front shovel loader, having a tactile control system as set out in claim 1.

9. A tactile control system for automated bucket loading of a loader having at least one hydraulic cylinder for imparting a motion to the bucket when loading said bucket with payload, said cylinder having a piston and a shaft of which one end is connected to the piston within the cylinder and the other is acting on the bucket so as to move said bucket when the shaft extends from the cylinder or retracts thereinto, said system comprising:

pressure sensing means for sensing hydraulic pressure on each side of the piston within the hydraulic cylinder;

extension sensing means for sensing the extension of the shaft; and a computer responsive to output signals of said pressure sensing means and said extension sensing means, said computer controlling valve means which control the pressure on each side of the piston within said hydraulic cylinder and adjust said pressure in response to forces exerted on the bucket during the loading operation, thereby also controlling the extension of the shaft as a function of said forces, wherein the loader has front wheels mounted on an axle, said system comprising axle load sensing means, and the computer also being responsive to output signals from said axle load sensing means to control the valve means which control the pressure on each side of the piston within the cylinder and adjust said pressure in response to the load exerted on the axle.

10. A system according to claim 9, further comprising front wheel RPM sensing means, and the computer also being responsive to output signals from said RPM sensing means and controlling the appropriate valve means to maintain said RPM within a predetermined range to minimize slippage of the wheels.

11. A tactile control system for automated bucket loading of a loader having at least one hydraulic cylinder for imparting a tilting motion to the bucket when loading said bucket with payload, said cylinder having a piston and a shaft of which one end is connected to the piston within the cylinder and the other is acting on the bucket so as to tilt said bucket according to a tilting trajectory when the shaft extends from the cylinder or retracts thereinto, said system comprising:

pressure sensing means for sensing hydraulic pressure on each side of the piston within the hydraulic cylinder;

extension sensing means for sensing the extension of the shaft; and a computer responsive to output signals of said pressure sensing means and said extension sensing means, said computer controlling valve means which control the pressure on each side of the piston within said hydraulic cylinder and adjust said pressure in response to forces exerted on the bucket during the loading operation, thereby also controlling the extension of the shaft as a function of said forces, further comprising RPM sensing means on the loader's engine, and the computer being responsive to output signals of said engine RPM sensing means to maintain said RPM within a predetermined range, thereby limiting abuse on transmission, axle and drive train of the loader.

12. A tactile control system for automated bucket loading of a loader having at least one hydraulic cylinder for imparting a tilting motion to the bucket when loading said bucket with payload, said cylinder having a piston and a shaft of which one end is connected to the piston within the cylinder and the other is acting on the bucket so as to tilt said bucket according to a tilting trajectory when the shaft extends from the cylinder or retracts thereinto, said system comprising:

pressure sensing means for sensing hydraulic pressure on each side of the piston within the hydraulic cylinder;

extension sensing means for sensing the extension of the shaft; and a computer responsive to output signals of said pressure sensing means and said extension sensing means, said computer controlling valve means which control the pressure on each side of the piston within said hydraulic cylinder and adjust said pressure in response to forces exerted on the bucket during the loading operation, thereby also controlling the extension of the shaft as a function of said forces, wherein the loader has a hydraulic steering cylinder, said system further comprising extension sensing means of said steering cylinder, and the computer also being responsive to output signals from said extension sensing means of said steering cylinder to maintain the loader substantially straight during the loading operation.

13. A tactile control system for automated bucket loading of a loader having at least one hydraulic cylinder for imparting a tilting motion to the bucket when loading said bucket with payload, said cylinder having a piston and a shaft of which one end is connected to the piston within the cylinder and the other is acting on the bucket so as to tilt said bucket according to a tilting trajectory when the shaft extends from the cylinder or retracts thereinto, said system comprising:

pressure sensing means for sensing hydraulic pressure on each side of the piston within the hydraulic cylinder;

extension sensing means for sensing the extension of the shaft; and a computer responsive to output signals of said pressure sensing means and said extension sensing means, said computer controlling valve means which control the pressure on each side of the piston within said hydraulic cylinder and adjust said pressure in response to forces exerted on the bucket during the loading operation, thereby also controlling the extension of the shaft as a function of said forces, further comprising a loader position sensing system with reference to a predetermined target and the computer being responsive to output signals from said position sensing system to control the position of the loader with reference to said target.

14. A system according to claim 13, in which said loader position sensing system is a laser positioning system mounted on the loader and projecting a laser beam onto the predetermined target behind the loader, comprising three reflective strips.

15. A tactile control system for automated bucket loading of a loader having at least one hydraulic cylinder for imparting a tilting motion to the bucket when loading said bucket with payload, said cylinder having a piston and a shaft of which one end is connected to the piston within the cylinder and the other is acting on the bucket so as to tilt said bucket according to a tilting trajectory when the shaft extends from the cylinder or retracts thereinto, said system comprising:

pressure sensing means for sensing hydraulic pressure on each side of the piston within the hydraulic cylinder;

extension sensing means for sensing the extension of the shaft; and a computer responsive to output signals of said pressure sensing means and said extension sensing means, said computer controlling valve means which control the pressure on each side of the piston within said hydraulic cylinder and adjust said pressure in response to forces exerted on the bucket during the loading operation, thereby also controlling the extension of the shaft as a function of said forces, further comprising temperature sensing means for hydraulic fluid used within the system, and the computer also being responsive to output signals from said temperature sensing means to maintain said temperature within predetermined limits.

16. A method for a tactile control of an automated bucket loading operation used in a front shovel loader which has at least one hydraulic cylinder for imparting a tilting motion to the bucket when loading said bucket with payload, said cylinder having a piston and a shaft of which one end is connected to the piston within the cylinder and the other is acting on the bucket so as to tilt said bucket according to a tilting trajectory when the shaft extends from the cylinder or retracts thereinto, said method comprising the steps of:

sensing the hydraulic pressure within the hydraulic cylinder on each side of the piston during the loading operation;

sensing the extension of the shaft during the loading operation;

converting output analog signals from the pressure and extension sensing steps into digital signals;

processing said digital signals so as to control valve means which control the pressure on each side of the piston within said hydraulic cylinder; and automatically adjusting said pressure on each side of the piston in response to forces exerted on the bucket during the loading operation and thereby controlling the extension of the shaft as a function of said forces.

17. A method according to claim 16, wherein the loader also has at least one hydraulic lift cylinder for lifting the bucket during or after loading thereof, said lift cylinder having a piston and a shaft of which one end is connected to the piston within the lift cylinder and the other acting on the bucket so as to lift it off the ground or lower it when required, said method further comprising the step of:

sensing the hydraulic pressure within the lift cylinder on each side of the piston during the loading operation;

sensing the extension of the shaft relative to the lift cylinder during the loading operation;

converting output analog signals from the lift cylinder pressure and extension sensing steps into digital signals;

processing said digital signals from the lift cylinder so as to compute the forces exerted on the bucket and to control valve means which control the pressure on each side of the piston within the lift cylinder; and automatically adjusting said pressure on each side of the lift cylinder piston in response to said forces.

18. Method according to claim 17, further comprising processing the signals from at least one of the hydraulic cylinder for imparting the tilting motion, the hydraulic lift cylinder, and the axle load sensing step, to compute the payload weight.

19. Method according to claim 18, further comprising the step of sensing the loader's inclination, converting output analog signals therefrom into digital signals and processing the resulting digital signals to enhance computation of the payload weight.

20. Method according to claim 18, in which the computation of the payload weight is carried out after the loading operation has been completed.

21. Method according to claim 16, further comprising the step of sensing RPM of the loader's engine, and processing the sensed RPM to maintain said engine RPM within a predetermined range thereby limiting abuse of loader's transmission, axle and drive train.

22. Method according to claim 16, wherein the loader has a hydraulic steering cylinder, said method further comprising the step of sensing the extension of said steering cylinder, converting output analog signals from said steering cylinder extension sensing step into digital signals and processing the same to maintain the loader substantially straight during the loading operation.

23. Method according to claim 16, further comprising the step of sensing the loader's position with reference to a predetermined target, converting output analog signals from said position sensing step into digital signals and processing the resulting digital signals to control the position of the loader during the loading operation.

24. Method according to claim 16, further comprising the step of sensing the temperature of the hydraulic fluid, converting output analog signals from said temperature sensing step into digital signals and processing the resulting digital signals to control various operations so as to maintain said temperature within predetermined limits.

25. Method according to claim 16, comprising carrying out all said steps continuously during the loading operation.

26. A method for a tactile control of an automated bucket loading operation using a loader which has at least one hydraulic cylinder for imparting a tilting motion to the bucket when loading said bucket with payload, said cylinder having a piston and a shaft of which one end is connected to the piston within the cylinder and the other is acting on the bucket so as to tilt said bucket according to a tilting trajectory when the shaft extends from the cylinder or retracts thereinto, said method comprising the steps of:

sensing the hydraulic pressure within the hydraulic cylinder on each side of the piston during the loading operation;

sensing the extension of the shaft during the loading operation;

converting output analog signals from the pressure and extension sensing steps into digital signals;

processing said digital signals so as to control valve means which control the pressure on each side of the piston within said hydraulic cylinder; and automatically adjusting said pressure on each side of the piston in response to forces exerted on the bucket during the loading operation and thereby controlling the extension of the shaft as a function of said forces, wherein the loader has front wheels mounted on an axle, comprising the step of sensing the load applied to said axle, converting output analog signals from said axle load sensing step into digital signals and processing the resulting digital signals to maintain said axle load within predetermined limits.

27. Method according to claim 26, further comprising the step of sensing the front wheel RPM and processing the sensed front wheel RPM to maintain said RPM within a predetermined range to minimize slippage of the wheels.

* * * * *